US011009022B2

(12) United States Patent
Robison et al.

(10) Patent No.: US 11,009,022 B2
(45) Date of Patent: May 18, 2021

(54) PUMPING UNIT COUNTERWEIGHT BALANCING

(71) Applicant: WEATHERFORD TECHNOLOGY HOLDINGS, LLC, Houston, TX (US)

(72) Inventors: Clark E. Robison, Tomball, TX (US); Alexander D. King, Houston, TX (US); Bryan A. Paulet, Spring, TX (US); Behrouz Ebrahimi, Katy, TX (US); Milo B. Woodward, Missouri City, TX (US); Jeremy M. Gomes, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 42 days.

(21) Appl. No.: 16/522,625

(22) Filed: Jul. 25, 2019

(65) Prior Publication Data

US 2019/0345927 A1 Nov. 14, 2019

Related U.S. Application Data

(62) Division of application No. 15/972,746, filed on May 7, 2018, now Pat. No. 10,598,172.

(51) Int. Cl.
*F04B 47/14* (2006.01)
*E21B 43/12* (2006.01)
(Continued)

(52) U.S. Cl.
CPC ..... *F04B 47/14* (2013.01); *E21B 43/127* (2013.01); *F04B 47/028* (2013.01); *F04B 17/03* (2013.01)

(58) Field of Classification Search
CPC ..... F04B 47/14; F04B 47/028; F04B 17/03; E21B 43/127; E21B 2043/125
See application file for complete search history.

(56) References Cited

U.S. PATENT DOCUMENTS 1,931,472 A 10/1933 Archer
2,074,792 A 3/1937 Lyne et al.
(Continued)

OTHER PUBLICATIONS

Takacs, Gabor, et al.; "The calculation of gearbox torque components on sucker-rod pumping units using dynamometer card data", J Petrol Explor Prod Technol (2016) 6:101-110, Original Paper—Production Engineering, dated May 30, 2015, 10 pages.
(Continued)

*Primary Examiner* — Aaron L Lembo
(74) *Attorney, Agent, or Firm* — Smith IP Services, P.C.

(57) ABSTRACT

A method of balancing a beam pumping unit can include securing counterweights to crank arms, thereby counterbalancing a torque applied at a crankshaft at a maximum torque factor position due to a polished rod load and any structural unbalance. A well system can include a beam pumping unit including a gear reducer having a crankshaft, crank arms connected to the crankshaft, a beam connected at one end to the crank arm and at an opposite end to a rod string polished rod, and counterweights secured to the crank arms, and in which a torque applied at the crankshaft at a maximum torque factor position due to weights of the crank arms, the counterweights and wrist pins equals a torque applied at the crankshaft at the maximum torque factor position due to a load applied to the beam via the polished rod and any structural unbalance.

5 Claims, 8 Drawing Sheets

(51) Int. Cl.
*F04B 47/02* (2006.01)
*F04B 17/03* (2006.01)

(56) References Cited

U.S. PATENT DOCUMENTS

| | | | | |
|---|---|---|---|---|
| 2,739,493 | A | 3/1956 | Eaton | |
| 2,867,134 | A | 1/1959 | Scherf et al. | |
| 3,371,554 | A | 3/1968 | McCray et al. | |
| 4,076,218 | A * | 2/1978 | Gault | F04B 47/02 254/286 |
| 4,490,094 | A | 12/1984 | Gibbs | |
| 4,505,162 | A | 3/1985 | Hoh et al. | |
| 10,094,371 | B2 | 10/2018 | Mills | |
| 2016/0003234 | A1 | 1/2016 | Mills | |
| 2019/0012492 | A1 | 1/2019 | Pons et al. | |

OTHER PUBLICATIONS

Feng, Zi-Ming, et al.; "A review of beam pumping energy-saving technologies", J Petrol Explor Prod Technol (2018) 8:299-311, Review Paper—Production Engineering, dated Aug. 29, 2017, 13 pages.

American Petroleum Institute; "Specification for Pumping Units", API Specification 11E, Nineteenth Edition, Nov. 2013, dated May 1, 2014, 116 pages.

Human Development Consultants Ltd.; "Describe and Operate Beam Pump", Training Module B, dated Jun. 2008, 24 pages.

Office Action dated Aug. 22, 2019 for U.S. Appl. No. 15/972,746, 14 pages.

Specification and drawings for U.S. Appl. No. 15/972,746, filed May 7, 2018, 42 pages.

* cited by examiner

PUMPING UNIT COUNTERWEIGHT BALANCING

CROSS-REFERENCE TO RELATED APPLICATION

This application is a division of prior application Ser. No. 15/972,746 filed on 7 May 2018. The entire disclosure of this prior application is incorporated herein by this reference.

BACKGROUND

This disclosure relates generally to equipment utilized and operations performed in conjunction with a subterranean well and, in an example described below, more particularly provides an improved method of balancing operation of a beam pumping unit.

Beam pumping units are sometimes referred to as pumpjacks or walking-beam pumping units. Typically, a beam pumping unit is balanced using counterweights that descend to convert potential energy to kinetic energy when a rod string connected to the pumping unit ascends to pump fluids from a well, and the counterweights ascend to convert kinetic energy to potential energy when the rod string descends in the well. Efficient operation of the pumping unit depends in large part on whether the counterweights effectively counterbalance loads imparted on the beam by the rod string.

Therefore, it will be readily appreciated that improvements are continually needed in the art of configuring beam pumping units for efficient operation, and more particularly in the art of selecting and locating counterweights so that loads imparted on a beam by a rod string are effectively counterbalanced. The disclosure below provides such improvements to the art, and the principles described herein can be applied advantageously to a variety of different beam pumping unit types and operational situations.

DETAILED DESCRIPTION

Figure 1:
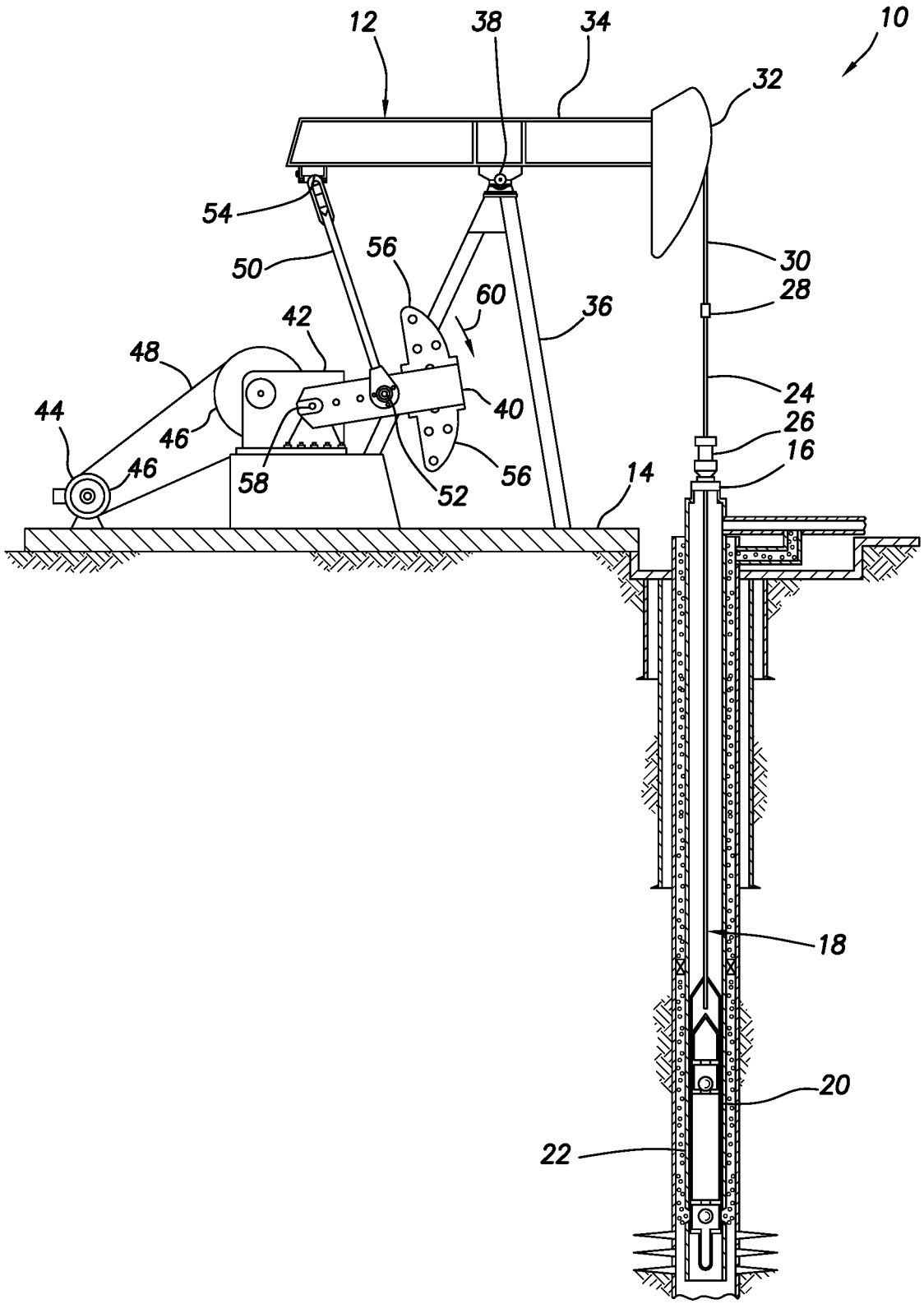
FIG. 1 is a representative partially cross-sectional view of an example of a well system and associated method which can embody principles of this disclosure.

Representatively illustrated in FIG. 1 is a system 10 and associated method for use with a subterranean well, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a walking beam-type surface pumping unit 12 is mounted on a pad 14 adjacent a wellhead 16. A rod string 18 extends into the well and is connected to a downhole pump 20 in a tubing string 22. Reciprocation of the rod string 18 by the pumping unit 12 causes the downhole pump 20 to pump fluids (such as, liquid hydrocarbons, gas, water, etc., and combinations thereof) from the well through the tubing string 22 to surface.

The pumping unit 12 as depicted in FIG. 1 is of the type known to those skilled in the art as a "conventional" pumping unit. However, the principles of this disclosure may be applied to other types of pumping units (such as, those known to persons skilled in the art as Mark II, reverse Mark, beam-balanced and end-of-beam pumping units). Thus, the scope of this disclosure is not limited to use of any particular type or configuration of pumping unit.

The rod string 18 may comprise a substantially continuous rod, or may be made up of multiple connected together rods (also known as "sucker rods"). At an upper end of the rod string 18, a polished rod 24 extends through a stuffing box 26 on the wellhead 16. An outer surface of the polished rod 24 is finely polished to avoid damage to seals in the stuffing box 26 as the polished rod reciprocates upward and downward through the seals.

A carrier bar 28 connects the polished rod 24 to a bridle 30. The bridle 30 typically comprises multiple cables that are secured to and wrap partially about an end of a horsehead 32 mounted to an end of a beam 34.

The beam 34 is pivotably mounted to a Samson post 36 at a saddle bearing 38. In this manner, as the beam 34 alternately pivots back and forth on the saddle bearing 38, the rod string 18 is forced (via the horsehead 32, bridle 30 and carrier bar 28) to alternately stroke upward and downward in the well, thereby operating the downhole pump 20.

The beam 34 is made to pivot back and forth on the saddle bearing 38 by means of crank arms 40 connected via a gear reducer 42 to a prime mover 44 (such as, an electric motor or a combustion engine). Typically, a crank arm 40 is connected to an crankshaft 58 of the gear reducer 42 on each lateral side of the gear reducer.

The gear reducer 42 converts a relatively high rotational speed and low torque output of the prime mover 44 into a relatively low rotational speed and high torque input to the crank arms 40 via the crankshaft 58. In the FIG. 1 example, the prime mover 44 is connected to the gear reducer 42 via sheaves 46 and belts 48.

The crank arms 40 are connected to the beam 34 via Pitman arms 50. The Pitman arms 50 are pivotably connected to the crank arms 40 by crankpins or wrist pins 52. The Pitman arms 50 are pivotably connected at or near an end of the beam 34 (opposite the horsehead 32) by tail or equalizer bearings 54.

It will be appreciated that the rod string 18 can be very heavy (typically weighing many thousands of pounds). In order to keep the prime mover 44 and gear reducer 42 from having to repeatedly lift the entire weight of the rod string 18 (and, additionally, any pumped fluids due to operation of the downhole pump 20, and overcoming friction), counterweights 56 are secured to the crank arm 40.

As depicted in FIG. 1, the gear reducer 42 rotates the crank arm 40 in a clockwise direction 60, and so the counterweights 56 assist in pulling the Pitman arms 50 (and the end of the beam 34 to which the Pitman arms are connected) downward, so that the rod string 18 is pulled upward. In this manner, the counterweights 56 at least partially "offset" the load applied to the beam 34 from the rod string 18 via the polished rod 24, carrier bar 28 and bridle 30.

As a matter of convention, a clockwise or counter-clockwise rotation of the crank arm 40 is judged from a perspective in which the horsehead 32 is positioned at a right-hand end of the beam 34 (as depicted in FIG. 1). The principles of this disclosure may be applied to pumping units having clockwise or counter-clockwise crank arm rotation but, for clarity and efficiency of description, clockwise rotation is assumed in the description below.

For various reasons (such as, varying rod string 18 weights, varying well conditions, etc.), the counterweights 56 can be located at various positions along the crank arms 40. In this manner, a torque applied by the counterweights 56 to the crankshaft 58 via the crank arms 40 can be adjusted to efficiently counteract a torque applied by the rod string 18 load via the beam 34, Pitman arms 50 and crank arms 40.

Ideally, all torques applied to the crankshaft 58 via the crank arms 40 would sum to zero or "cancel out," so that the prime mover 44 and gear reducer 42 would merely have to overcome friction due to the reciprocating motion of the various components of the pumping unit 12 and rod string 18. The pumping unit 12 would (in that ideal situation) be completely "balanced," and minimal energy would need to be input via the prime mover 44 to pump fluids from the well.

The principles described below can be used to achieve partial or complete balancing of the pumping unit 12. In some examples, this balancing is achieved by determining positions of the counterweights 56 that will best counteract other torques applied to the crankshaft 58.

Figure 2:
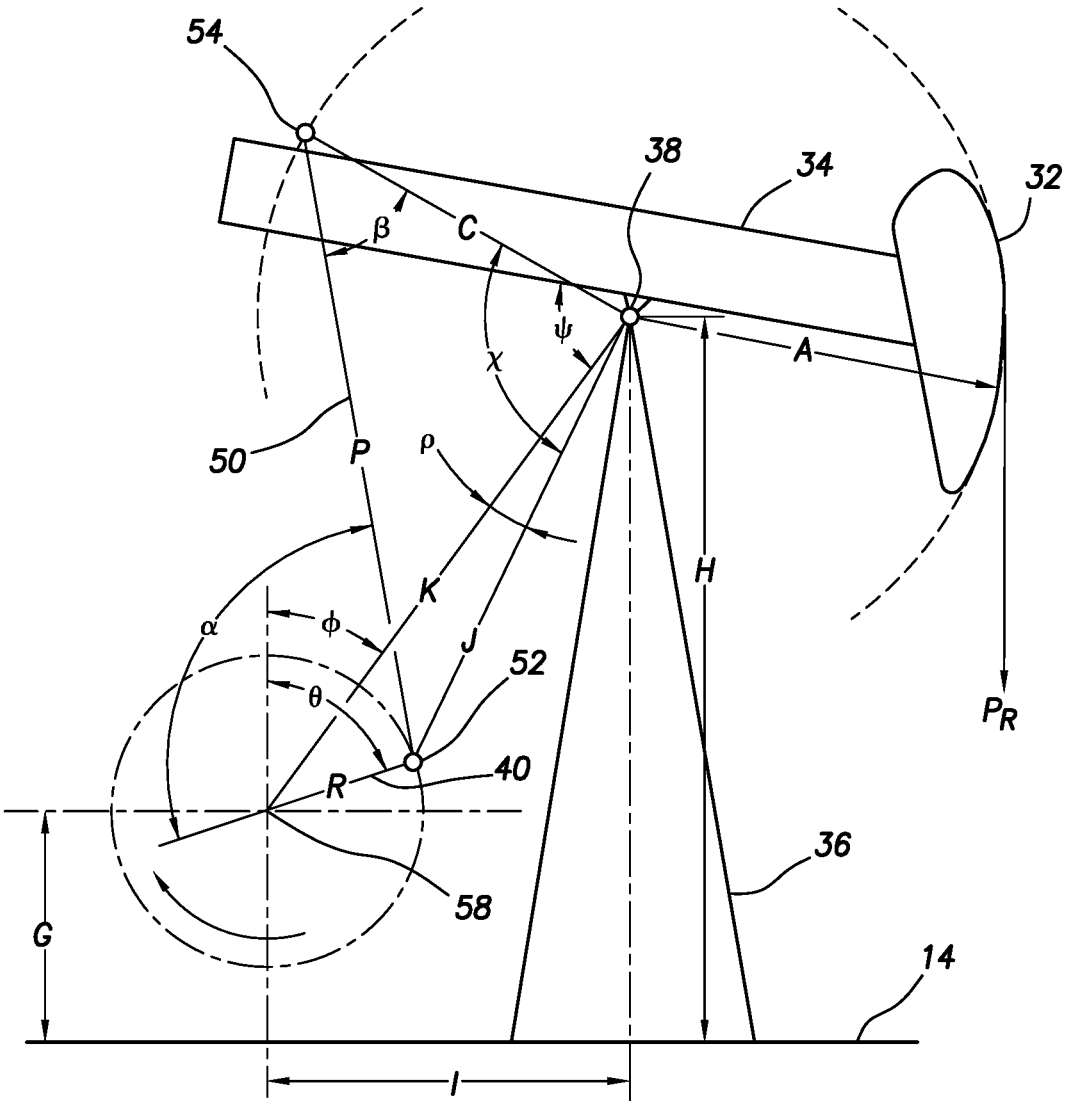
FIGS. 2 & 3 are representative graphics of an example of a pumping unit in respective upstroke and downstroke configurations.
Figure 3:
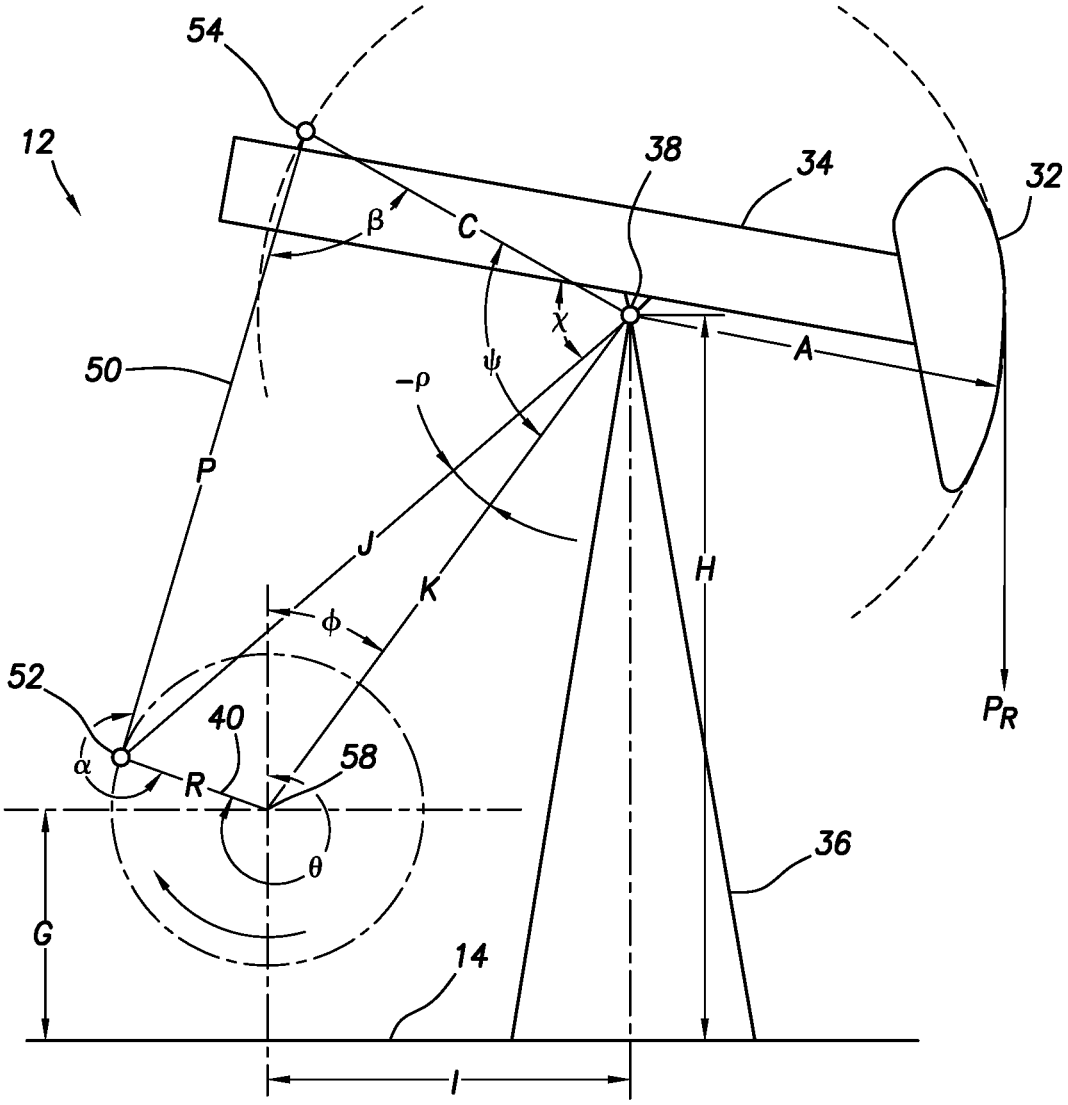

In order to provide a basis for nomenclature used in calculations described more fully below, FIGS. 2 & 3 depict an example of the pumping unit 12 in respective upstroke and downstroke configurations with industry standard notations for various geometric characteristics of the pumping unit. FIGS. 2 & 3 are derived from an American Petroleum Institute (API) specification 11E (19$^{th}$ ed., November 2013), Annex D, Figure D.1.

The geometric characteristics depicted in FIGS. 2 & 3 are as follows:

A is beam 34 length from center of saddle bearing 38 to centerline of polished rod 24, in inches (in.) or millimeters (mm).

C is beam 34 length from center of saddle bearing 38 to center of tail or equalizer bearing 54, in inches (in.) or millimeters (mm).

G is height from the center of the crankshaft 58 to the bottom of the Samson post 36, in inches (in.) or millimeters (mm).

H is height from the center of the saddle bearing 38 to the bottom of the Samson post 36, in inches (in.) or millimeters (mm).

I is horizontal distance between the centerline of the saddle bearing 38 and the centerline of the crankshaft 58, in inches (in.) or millimeters (mm).

J is distance from the center of the wrist pin 52 to the center of the saddle bearing 38, in inches (in.) or millimeters (mm).

K is distance from the center of the crankshaft 58 to the center of the saddle bearing 38, in inches (in.) or millimeters (mm).

P is effective length of the Pitman arm 50 (from the center of the equalizer bearing 54 to the center of the crankpin or wrist pin 52), in inches (in.) or millimeters (mm).

$P_R$ is the load applied via the polished rod 24, also known as PRL (polished rod load), in pounds (lb.) or newtons (N).

R is distance from the center of the crankshaft 58 to the center of the wrist pin 52, in inches (in.) or millimeters (mm).

θ is angle of the crank arm 40, with 0° being vertically upward.

φ is angle of a line between the crankshaft 58 and the saddle bearing 38, and vertical.

ψ is angle of a line between the crankshaft 58 and the saddle bearing 38, and the equalizer bearing 54.

χ is angle between the equalizer bearing 54, and a line between the wrist pin 52 and the saddle bearing 38.

ρ is angle between the line between the crankshaft 58 and the saddle bearing 38, and the line between the wrist pin 52 and the saddle bearing 38.

β is angle between the line between the saddle bearing 38 and the equalizer bearing 54, and the Pitman arm 50.

α is angle between the Pitman arm 50 and the crank arm 40.

Some useful equations for calculating some of these include the following:

$$\varphi=\tan^{-1}(I/(H-G)).$$

$$\beta=\cos^{-1}((C^2+P^2-K^2-R^2+KR\cos(\theta-\varphi))/2CP).$$

$$\chi=\cos^{-1}((C^2+J^2-P^2)/2CJ).$$

$$\rho=\sin^{-1}+/-(R\sin(\theta-\varphi)/J).$$

The angle ρ should be taken as a positive angle when sin ρ is positive. This occurs for crank arm 40 positions between (θ−φ)=0° and (θ−φ)=180°. The angle ρ should be taken as a negative angle when sin ρ is negative. This occurs for crank positions between (θ−φ)=180° and (θ−φ)=360°.

$$\psi=\chi-\rho.$$

At the bottom of the rod string 18 stroke, $\psi b=\cos^{-1}((C^2+K^2-(P+R)^2)/2CK)$. At the top of the rod string 18 stroke, $\psi t=\cos^{-1}((C^2+K^2-(P-R)^2)/2CK)$.

$$\alpha=\beta+\psi-(\theta-\varphi).$$

$$J=(C^2+P^2-2CP\cos\beta)^{1/2}$$

Additional factors or nomenclature used in calculations below include the following:

B is structural unbalance, equal to the force at the polished rod 24 required to hold the beam 34 in a horizontal position with the Pitman arms 50 disconnected from the wrist pins 52, in pounds (lb) or newtons (N). This force is positive when acting downward and negative when acting upward.

PRP is polished rod 24 position expressed as a fraction of the stroke length above the lowermost position for a given crank arm 40 angle θ, and is unitless. PRP=(ψb−ψ)/(ψb−ψt), or PRP=A(ψb−ψ).

TF is torque factor, used to calculate a torque applied at the crankshaft 58 due to the polished rod load PRL. TF=(AR/C)(sin α/sin β), in inches (in.), or TF=(AR/1000 C)(sin α/sin β), in meters (m). The torque T applied at the crankshaft 58 due to the polished rod load PRL is nominally given by T=TF(PRL), in inch-pounds (in.-lb) or newton-meters (Nm).

Figure 4:
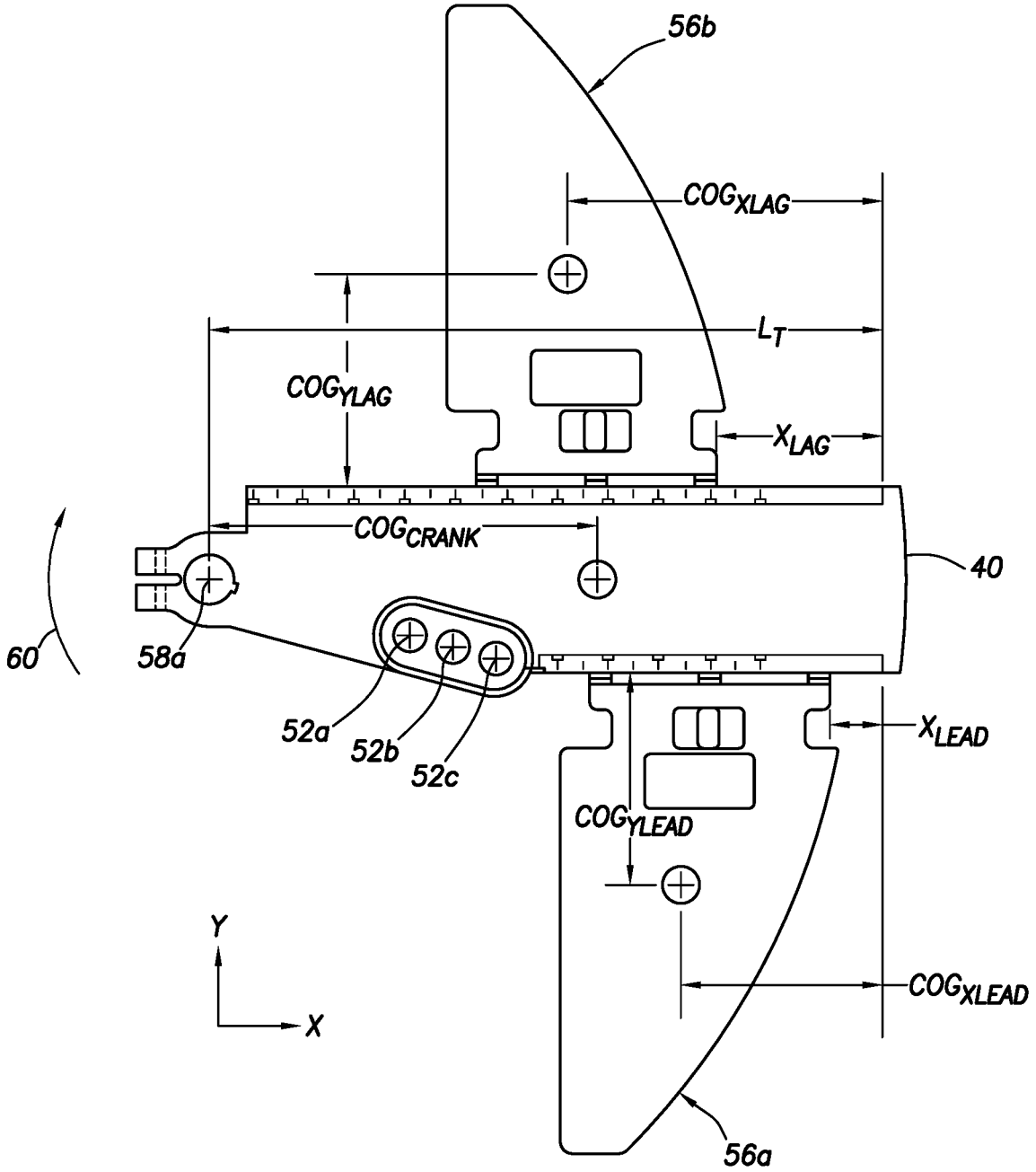
FIG. 4 is a representative side view of an example of counterweights and a crank arm that may be used with the pumping unit.

Referring additionally now to FIG. 4, an example of the crank arm 40 and counterweights 56 is representatively illustrated, apart from the remainder of the pumping unit 12. The crank arm 40 is depicted in a horizontal position (θ=90°) for convenience of description, and due to the fact that adjustments to counterweight positions are typically made with the crank arm in a horizontal position (θ=90° or θ=270°).

In this example, there are two counterweights 56 secured to the crank arm 40: a "leading" counterweight 56*a*, and a "trailing" or "lagging" counterweight 56*b*. The leading and lagging designations are relative to the direction of rotation 60 (clockwise in this example).

As depicted in FIG. 4, there are three center positions 52*a-c* provided for the wrist pin 52. Locating the wrist pin 52 in the position 52*c* will result in a longest stroke length, and will directly affect the effective crank arm 40 length (distance R, see FIGS. 2 & 3). Similarly, locating the wrist pin 52 in the position 52*a* will result in a shortest stroke length and shortest effective crank arm 40 length R.

The crankshaft 58 is received at center position 58*a* in the crank arm 40. The counterweights 56*a,b* can be positioned a maximum length $L_T$ from the crankshaft position 58*a*. Measured from an outer end of the length $L_T$, the leading counterweight 56*a* is positioned a distance $X_{LEAD}$ inward toward the crankshaft position 58*a*, and the lagging counterweight 56*b* is positioned a distance $X_{LAG}$ inward toward the crankshaft position 58*a*.

The leading counterweight 56*a* has a center of gravity positioned a distance $COG_{XLEAD}$, measured from an outer end of the length $L_T$ in the X (horizontal) direction, and positioned a distance $COG_{YLEAD}$, measured from the crank arm 40 in the Y (vertical) direction. The lagging counterweight 56*b* has a center of gravity positioned a distance $COG_{XLAG}$, measured from an outer end of the length $L_T$ in the X (horizontal) direction, and positioned a distance $COG_{YLAG}$, measured from the crank arm 40 in the Y (vertical) direction. A center of gravity of the crank arm 40 is positioned a horizontal distance $COG_{CRANK}$ from the crank shaft position 58*a*.

Nomenclature used in some of the calculations below include the following:

$Wt_{LEAD}$ is the weight of leading counterweight 56*a*, in pounds (lb.) or newtons (N).

$Wt_{LAG}$ is the weight of lagging counterweight 56*b*, in pounds (lb.) or newtons (N).

$Wt_{CRANK}$ is the weight of crank arm 40, in pounds (lb.) or newtons (N).

$Wt_{WRIST}$ is the weight of the wrist pin 52, in pounds (lb.) or newtons (N).

$W_{CRANK}$ is the width (in the Y direction) of the crank arm 40, in inches (in.) or millimeters (mm).

Figure 5:
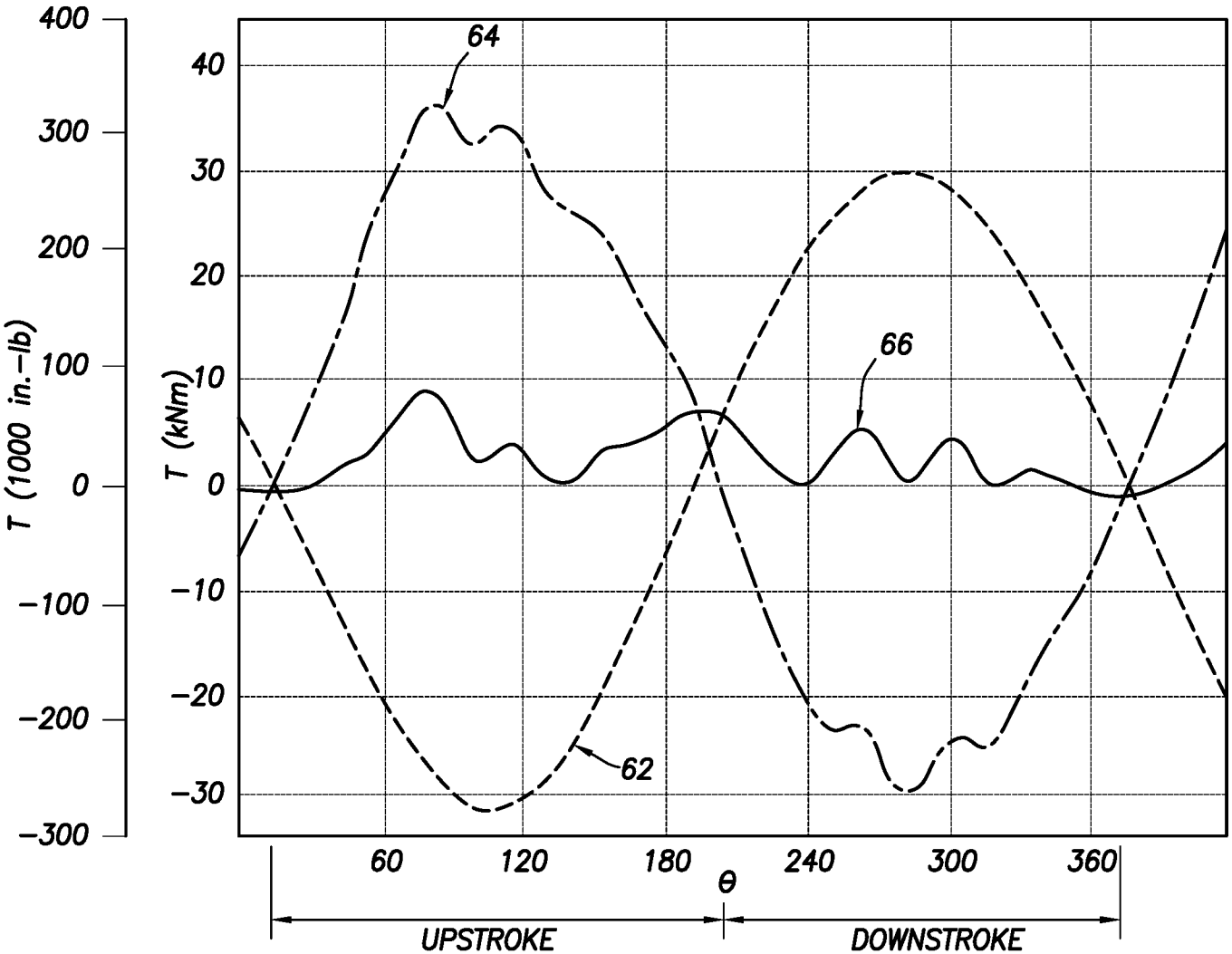
FIG. 5 is a representative example graph of torque versus angular position of the crank arm and counterweights.

Referring additionally now to FIG. 5, an example representative graph of torque T versus crank arm angle θ is representatively illustrated. FIG. 5 is derived from Figure G.3 of the API specification 11E.

Note that the rod string 18 upstroke in this example begins at about θ=13.85°, and the downstroke begins at about θ=207.70°. In other examples, these values may be different, depending on the geometry of the pumping unit 12.

In FIG. 5, a dashed line 62 represents the torque $T_{CB}$ at the crankshaft 58 due to the counterbalancing components, including the counterweights 56, the crank arms 40 and the wrist pins 52. Another line 64 with alternating short and long dashes represents the torque T at the crankshaft 58 due to the polished rod load PRL. As mentioned above, T=TF(PRL).

A solid line 66 represents the net torque at the crankshaft 58, which results from summing $T+T_{CB}$, and accounting for inertial effects. In order to prevent damage to the gear reducer 42, provide for efficient operation of the prime mover 44, and reduce wear and maintenance requirements, it would be desirable to reduce the net torque (represented by line 66) as much as practicable.

In the past, attempts to balance a beam pumping unit have started with calculations of positions of the counterweights at θ=90° and θ=270° (horizontal positions on the upstroke and downstroke, respectively) that would result in a minimal difference in net torque at those crankshaft angles. The counterweights were located at the calculated positions, and the pumping unit was operated. Measurements of electrical motor current during operation of the pumping unit were used to determine whether the pumping unit was indeed operating efficiently and, therefore, "balanced."

Typically, the initial positions of the counterweights did not result in an efficient, balanced operation of the pumping unit, and so incremental adjustments, based on experienced guesses or "rules of thumb," were made, followed by further operation of the pumping unit with electrical current measurements being made. This process was repeated as many times as necessary, until a satisfactory operation of the pumping unit was achieved.

Unfortunately, such "balancing" operations were hazardous, time-consuming, inefficient and costly. For example, it can take an hour or more to make each adjustment of counterweight position, and this typically requires the services of multiple technicians. Access to electrical panels during pumping unit operation to make high voltage (e.g., 420 volts) current measurements could be unsafe. Furthermore, it was unknown whether the pumping unit was actually in an optimally "balanced" condition at the conclusion of the operation.

The present inventors have conceived that it would be far more effective to "balance" the pumping unit 12 at the crank arm 40 position at which the torque factor TF value is greatest. This is the position at which the polished rod load PRL exerts the greatest torque T at the crankshaft 58.

The torque factor TF is not at its greatest value when the crank arm 40 is at the θ=90° and θ=270° positions. In the FIG. 5 example, the torque factor TF is greatest at approximately θ=80°, and least at approximately θ=280°. These values may be different for corresponding different pumping unit geometries.

In general, for a conventional pumping unit, the maximum positive torque factor TF will be in the range of approximately 70-80°, and the maximum negative torque factor TF will be in the range of approximately 280-285°. However, the scope of this disclosure is not limited to use of a conventional pumping unit, or to any particular positions of maximum positive or negative torque factors TF.

Figure 6:
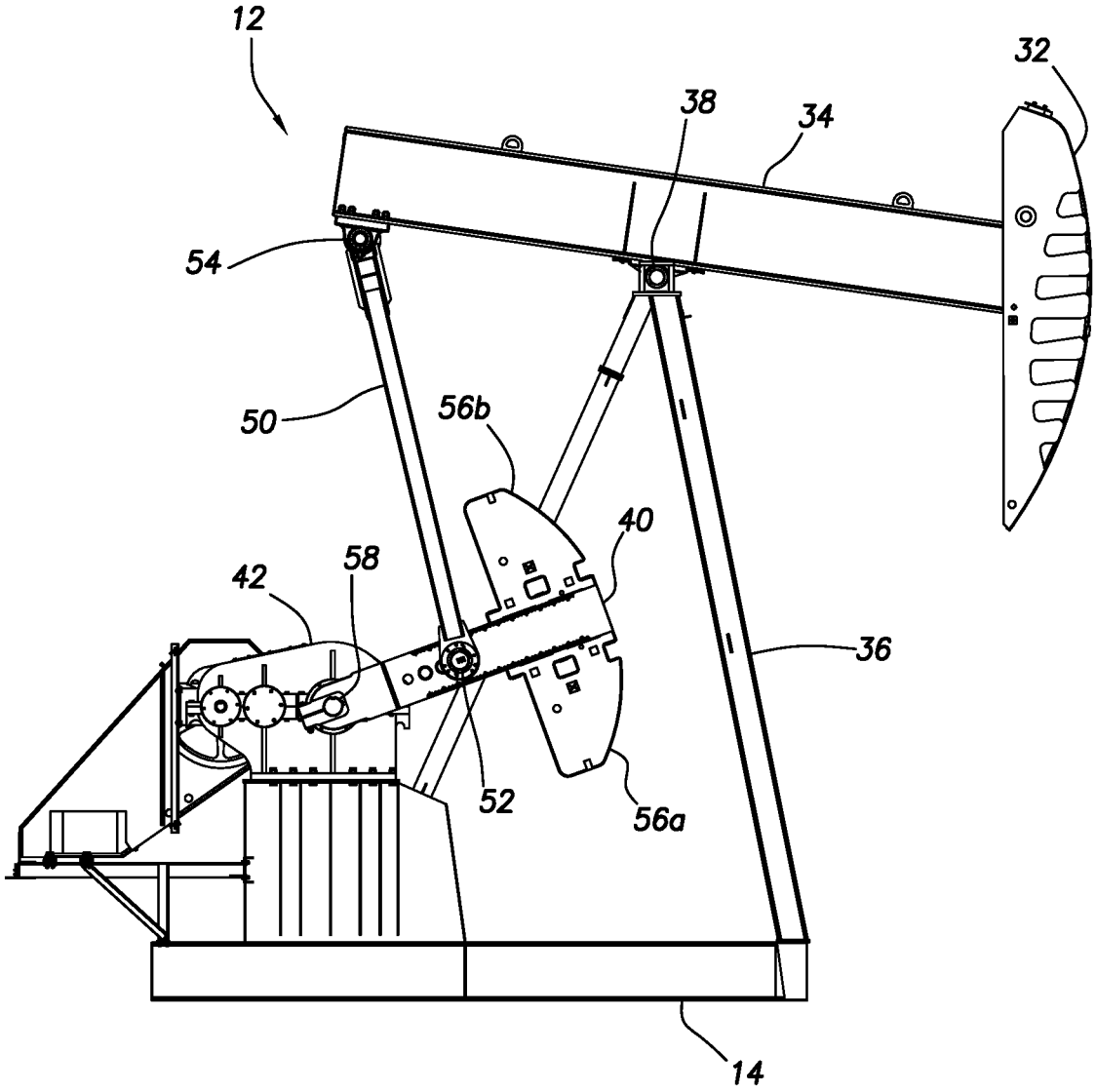
FIGS. 6 & 7 are representative side views of an example of a pumping unit at maximum and minimum torque factor positions of the crank arm and counterweights.
Figure 7:
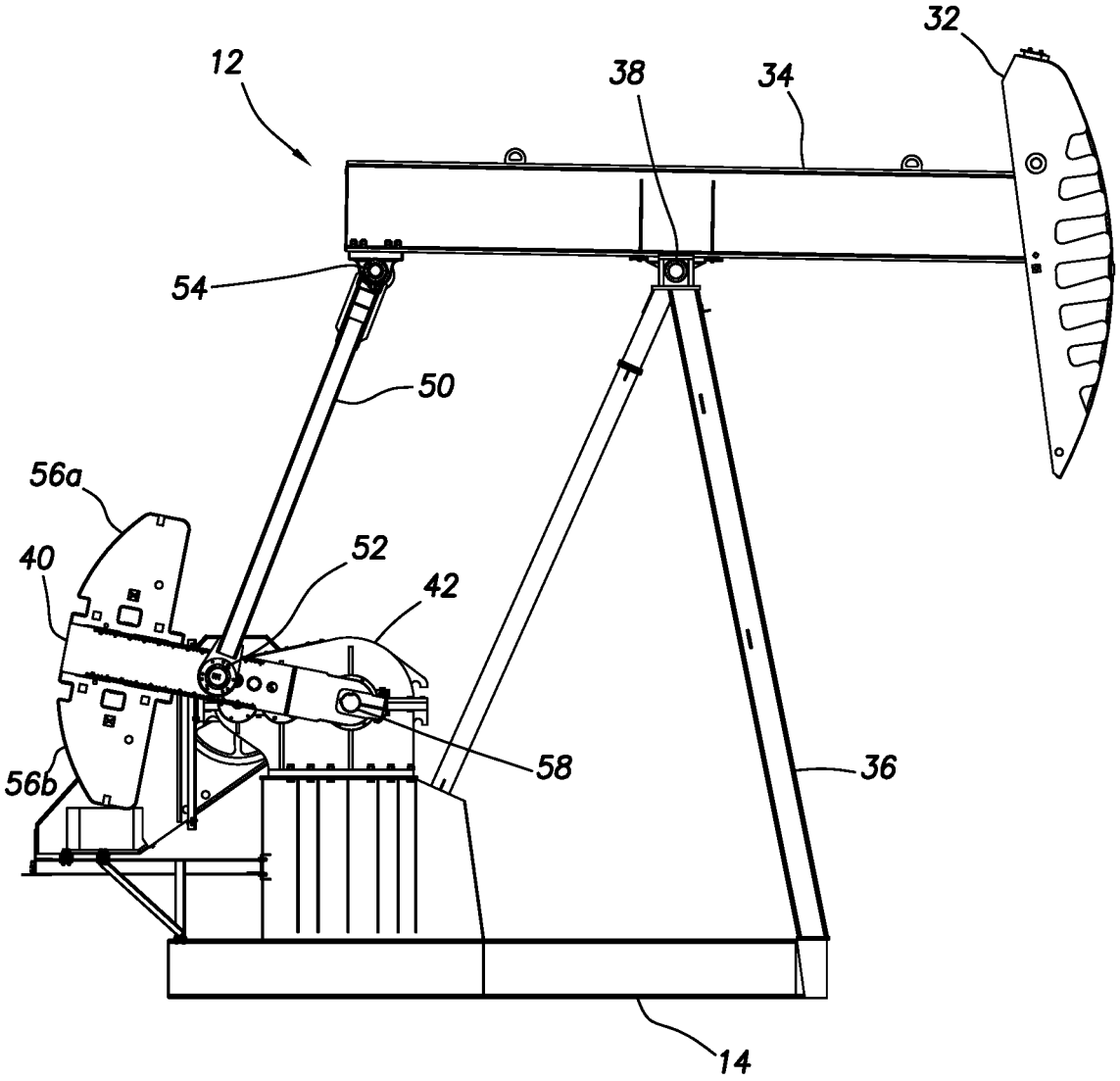

Referring additionally now to FIGS. 6 & 7, another example of the pumping unit 12 is representatively illustrated. In FIG. 6, the crank arm 40 is at an upstroke position in which the torque factor TF has a maximum positive value. In FIG. 7, the crank arm 40 is at a downstroke position in which the torque factor TF has a maximum negative value.

In the FIG. 6 example, the crank arm 40 angle is at approximately θ=75°. In the FIG. 7 example, the crank arm 40 angle is at approximately θ=280°. Depending on the type, crank arm rotation direction and geometry of the pumping unit 12, the torque factor TF may have a greatest absolute value on the upstroke (e.g., as depicted in FIG. 6), or on the downstroke (e.g., as depicted in FIG. 7). Thus, the scope of this disclosure is not limited to any particular relative relationship between the torque factor TF on the upstroke and on the downstroke.

In a method of balancing the pumping unit 12 described more fully below, it is desired to minimize a difference between the torque at the crankshaft 58 due to the counterbalancing components (the crank arms 40, the wrist pins 52 and the counterweights 56*a,b*) at the FIG. 6 position of the crank arms (that is, with the torque factor TF at its maximum positive value on the upstroke), and at the FIG. 7 position of the crank arms (that is, with the torque factor TF at its minimum (maximum negative) value on the downstroke). In equations presented below, the torque factor TF at its maximum absolute value on the upstroke is designated $TF_{MAX\ UP}$, and the torque factor TF at its maximum absolute value on the downstroke is designated $TF_{MAX\ DOWN}$.

Figure 8:
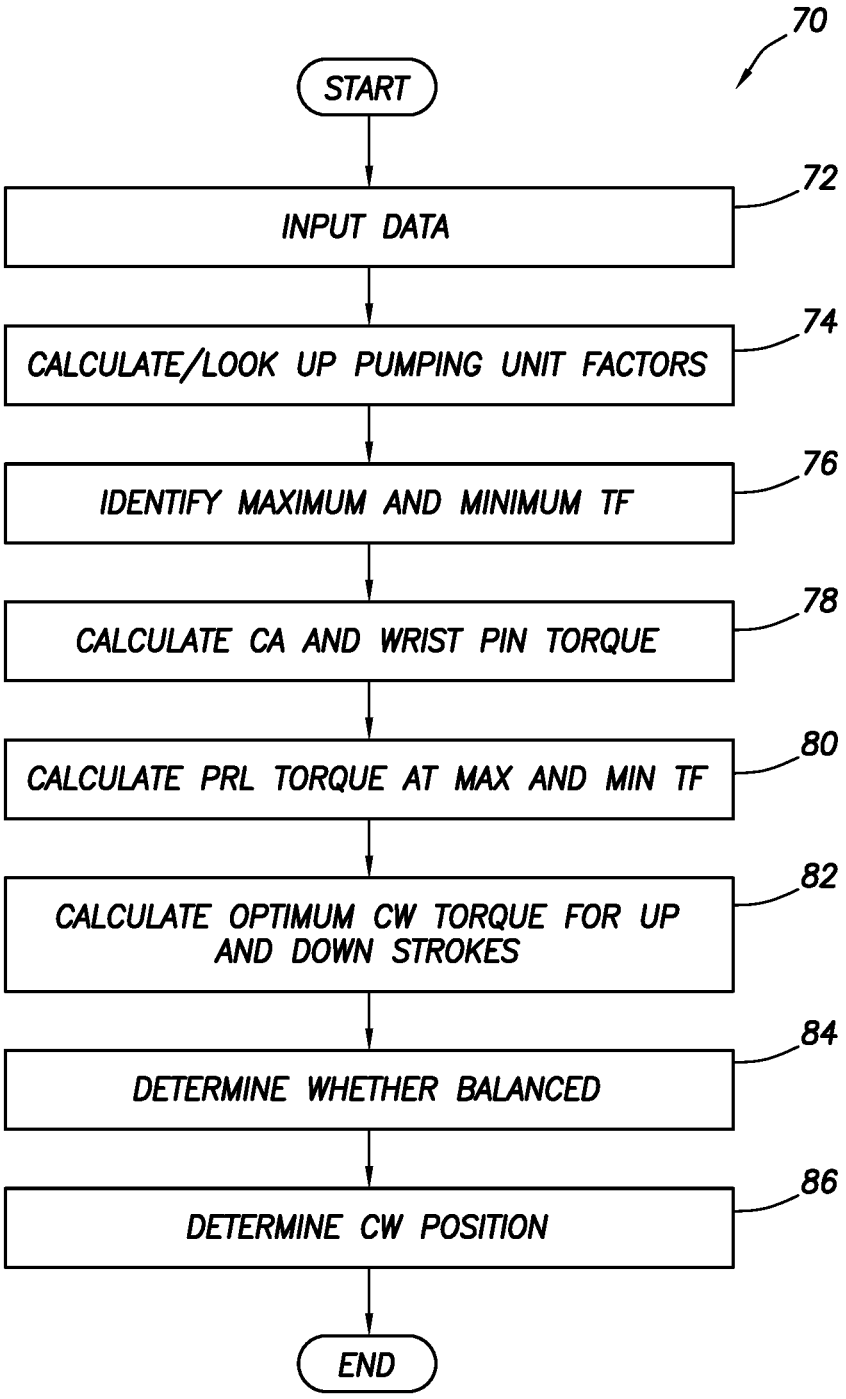
FIG. 8 is a representative flowchart for an example of a method of balancing the pumping unit.

Referring additionally now to FIG. 8, a representative flowchart for an example method 70 of balancing the pumping unit 12 is depicted. The method 70 may be used to balance the pumping unit 12 having the counterweights 56*a,b* already secured to the crank arms 40, if the pumping unit has previously been operated at a well. It may, in that case, be desired to reposition the counterweights 56*a,b* in a safe, economical and quick manner, so that the pumping unit 12 operates more efficiently. However, the principles of this disclosure may in other examples be used to initially position the counterweights 56*a,b* on the crank arms 40, prior to first operation of the pumping unit 12 at a well.

It is contemplated that the method 70 may be implemented with the assistance of one or more computing devices, such as, a desk or portable computer, a personal digital assistant, a programmable tablet or pad, etc. Executable instructions for performing the calculations described herein may be stored in memory associated with the computing device. In addition, tables of the geometric characteristics of a variety of different pumping units may also be stored in the memory.

An operator may input well data, pumping unit identification, customer preferences or any other information to the computing device for use in the calculations. The computing device may include a display, printer or other output device for displaying to the operator the results of the calculations. The input and/or output functions may be performed at the well site or at a remote site (for example, via satellite, cellular data, wide area network, local area network, Internet, radio frequency, or any other communication means).

The steps of the method 70 described below may be performed by any equipment, devices, code or combinations thereof now known to those skilled in the art or hereafter developed. Thus, the scope of this disclosure is not limited to any particular equipment, devices, code or other means used to implement the method 70.

Steps 72-86 are described below for one particular example of the method 70. However, it should be clearly understood that it is not necessary for all of the steps to be performed each time the method 70 is practiced, and it is not necessary for the steps to be performed in the same order as depicted in FIG. 8 and described herein. Steps may be combined, individual steps may be divided into multiple separate steps, or different steps or different combinations of steps may be used, in other examples. Thus, the scope of this disclosure is not limited to the steps 72-86 as depicted in FIG. 8 and described herein.

In step 72, data is input. The operator may input certain data, such as, an identification of the pumping unit 12, an identification of the well, customer preferences, recommended values, well data, etc.

In some examples, the identification of the pumping unit 12 may enable the computing device to look up the geometric characteristics of the pumping unit. Alternatively, the operator may input the geometric characteristics.

In some examples, the customer preferences could include whether it is desired for the pumping unit 12 to be configured "crank-heavy" (so that, at rest, the crank arms 40 fall to a vertically downward θ=180° position) or "rod-heavy" (so that, at rest, the crank arms 40 rise to at or near a vertically upward θ=0° position).

Another customer preference may be an acceptable balance tolerance (since it can be unreasonable to expect that the torque T will be perfectly "canceled out" by the torque $T_{CB}$ at the crankshaft 58). This tolerance could in some examples be expressed as a percentage of the gear reducer 42 rating, a percentage of the prime mover 44 horsepower rating, or a prime mover 44 current draw. Alternatively, the tolerance may be recommended by the operator or a representative of the operator's employer.

In some examples, the well data input in step 72 could include a depth to the downhole pump 20, a size of the downhole pump, pump fillage, peak and minimum polished rod loads PRL, etc. The pumping unit data could include crank arm 40 identification or dimensions, wrist pin 52 location (e.g., position 52*a, b* or *c*, see FIG. 4), counterweight 56 identification, counterweight position (e.g., $X_{LAG}$ & $X_{LEAD}$, see FIG. 4), rotation direction (clockwise or counter-clockwise), prime mover 44 identification, sheave 46 sizes, etc.

The scope of this disclosure is not limited to any particular data or information or combinations thereof input in step 72.

In step 74, various pumping unit 12 factors are calculated or retrieved, based on the inputs in step 72. For example, the geometric characteristics of the pumping unit 12 may be retrieved from a look-up table stored in memory, based on the identification of the pumping unit input in step 72. Values for A, B, C, G, H, J, K, P, R, B, $COG_{CRANK}$, $Wt_{LEAD}$, $Wt_{LAG}$, $Wt_{CRANK}$, $Wt_{WRIST}$ and $W_{CRANK}$ may be retrieved from memory based on inputs in step 72.

Values for φ, β, χ, ρ, ψ, α, J, PRP and TF, may be calculated for various crank arm 40 angles θ (for example, at every 15° of rotation). Alternatively, these values may be retrieved from memory, based on the inputs in step 72 (pumping unit manufacturers typically make some or all of these values publicly available).

In step 76, the maximum absolute values of the torque factor TF on the upstroke and the downstroke ($TF_{MAX\ UP}$ and $TF_{MAX\ DOWN}$) are identified, as well as the corresponding respective crank arm 40 angles ($\theta_{TF\ MAX\ UP}$ and $\theta_{TF\ MAX\ DOWN}$). These values may be retrieved from memory (such as, from a look-up table) or calculated in step 74.

In step 78, the maximum torque $T_{CRANK}$ at the crankshaft 58 due to the weight of the crank arms 40 is calculated. The following equation may be used for this calculation:

$$T_{CRANK}=2Wt_{CRANK}(COG_{CRANK}).$$

In step 80, the maximum torque $T_{WRIST}$ at the crankshaft 58 due to the weight of the wrist pins 52 is calculated. The following equation may be used for this calculation:

$$T_{WRIST}=2Wt_{WRIST}(R).$$

A sum of the maximum torque $T_{C+W}$ due to the crank arms 40 and the wrist pins 52 may be calculated as follows:

$$T_{C+W}=T_{CRANK}+T_{WRIST}.$$

In step 80, the torques $T_{CBE\ UP}$ and $T_{CBE\ DOWN}$ at the crankshaft 58 due to the polished rod load PRL at each of the maximum absolute values of the torque factor TF on the upstroke and the downstroke ($TF_{MAX\ UP}$ and $TF_{MAX\ DOWN}$) are calculated. The following equations may be used for these calculations, and accounting for the structural unbalance B:

$$T_{CBE\ UP}=TF_{MAX\ UP}(PRL-B).$$

$$T_{CBE\ DOWN}=TF_{MAX\ DOWN}(PRL-B).$$

In the above equations, PRL is an average of the polished rod 24 load on the upstroke and on the downstroke.

In step 82, a desired torque $T_{CW}$ due to the counterweights 56 at each of the maximum absolute values of the torque factor TF on the upstroke and the downstroke ($TF_{MAX\ UP}$ and $TF_{MAX\ DOWN}$) are calculated. The following equations may be used for this calculation:

$$T_{CW\ UP}=T_{CBE\ UP}-T_{C+W}(\sin\theta_{TF\ MAX\ UP}).$$

$$T_{CW\ DOWN}=T_{CBE\ DOWN}-T_{C+W}(\sin\theta_{TF\ MAX\ DOWN}).$$

Knowing the desired torques $T_{CW\ UP}$ and $T_{CW\ DOWN}$ due to the counterweights 56 at the maximum absolute values of the torque factor TF, corresponding desired positions of the leading and lagging counterweights 56*a,b* can be readily determined, as described more fully below.

In step 84, a determination is made as to whether the desired torques $T_{CW\ UP}$ and $T_{CW\ DOWN}$ due to the counterweights 56 at the maximum absolute values of the torque factor TF will result in a sufficient balancing of the pumping unit 12 within the tolerance specified in step 72. The pumping unit 12 will be considered to be sufficiently balanced, if the following equation/condition is satisfied (otherwise, the pumping unit is not sufficiently balanced):

$$\mathrm{ABS}(T_{CW\ UP}-T_{CW\ DOWN})\leq\text{Tolerance}.$$

The Tolerance used in the equation above is expressed as a torque at the crankshaft 58. Depending on how the Tolerance is expressed by the operator, customer or operator's employer's representative (e.g., as a percentage of the gear reducer 42 rating, a percentage of the prime mover 44 horsepower rating, or a prime mover 44 current draw) in step 72, a corresponding equation may be used to convert it to torque at the crankshaft 58.

If the Tolerance is expressed as a percentage of the gear reducer 42 rating, the following equation may be used:

$$\text{Tolerance}=(\text{percentage})(GR_{RATING}),$$

in which $GR_{RATING}$ is the gear reducer 42 maximum torque rating.

If the Tolerance is expressed as a percentage of the prime mover 44 horsepower rating, the following equation may be used:

$$\text{Tolerance}=(\text{percentage})(PM_{RATING})(HPT)(GR_{RATIO}),$$

in which $PM_{RATING}$ is the prime mover 44 maximum horsepower rating, HPT is a horsepower-to-torque conversion factor (alternatively, a prime mover 44 maximum torque rating could be used for $PM_{RATING}$) and $GR_{RATIO}$ is the gear reducer 42 final gear ratio.

If the Tolerance is expressed as a prime mover 44 current draw, the following equation may be used:

$$\text{Tolerance}=(\text{current draw})(AT)(GR_{RATIO}),$$

in which AT is a current-to-torque conversion factor for the prime mover 44 and $GR_{RATIO}$ is the gear reducer 42 final gear ratio.

A check whether the desired torques $T_{CW\ UP}$ and $T_{CW\ DOWN}$ due to the counterweights 56 at the maximum absolute values of the torque factor TF will result in a crank-heavy or a rod-heavy condition may also be performed in step 84. The following equations may be used for pumping units with clockwise rotation of the crank arms 40:

If $(T_{CW\ UP}-T_{CW\ DOWN})<0$, then the pumping unit is crank-heavy.

If $(T_{CW\ UP}-T_{CW\ DOWN})>0$, then the pumping unit is rod-heavy.

If the determinations made in step 86 indicate that the pumping unit 12 will not be sufficiently balanced, or will not be in an acceptable crank-heavy or rod-heavy condition, then suitable substitute counterweights 56 and/or crank arms 40 may be selected to replace those for which inputs were made in step 72.

If the determinations made in step 86 indicate that the pumping unit 12 will be sufficiently balanced, and will be in an acceptable crank-heavy or rod-heavy condition, using the counterweights 56 and crank arms 40 for which inputs were made in step 72, then in step 86 suitable positions of the counterweights along the crank arms 40 are determined. To avoid undue stress on the gear reducer 42, the counterweights 56*a,b* on the crank arms 40 should be configured the same on both sides of the gear reducer ($X_{LEAD}$ is the same on both crank arms, and $X_{LAG}$ is the same on both crank arms), and the same counterweights are used on both crank arms.

For ease of calculation, it is preferable that the leading and lagging counterweights 56*a,b* are located at a same position on a crank arm 40 (that is, $X_{LEAD}=X_{LAG}$). This configuration is most suitable when the pumping unit 12 is being set up prior to its initial operation at a well. If, however, the pumping unit 12 has previously been operated, so that the counterweights 56*a,b* are already secured to the crank arms 40, then to avoid the additional time and effort required to relocate both counterweights on each crank arm, it may be preferable to relocate only one of the counterweights on each crank arm.

If the counterweights 56*a,b* are to be located so that their centers of gravity are at a same position along the crank arms 40, then the following equation may be used to determine the horizontal distance $L_{COG\ CW}$ from the crankshaft position 58*a* to the center of gravity of the counterweights:

$$L_{COG\ CW}=T_{CW\ UP}/(2(Wt_{LEAD}+Wt_{LAG})\sin\theta TF_{MAX\ UP}).$$

The desired torque $T_{CW\ UP}$ at the crankshaft 58 due to the counterweights 56*a,b* for the upstroke, and the crank angle $\theta_{TF\ MAX\ UP}$ at the maximum torque factor on the upstroke, are used in the above equation for the case in which a conventional pumping unit 12 is used, and it is desired for the unit to be configured crank-heavy. If it is desired for the unit to be configured rod-heavy, or if a different type of pumping unit is used, the desired torque $T_{CW\ DOWN}$ at the crankshaft 58 due to the counterweights 56*a,b* for the downstroke and the crank angle $\theta_{TF\ MAX\ DOWN}$ at the maximum absolute value torque factor on the downstroke may be used in the above equation.

In this example, the distance from the outer edge of the counterweights 56*a,b* to the maximum outward adjustment will be given by the following equation:

$$X_{LAG}=X_{LEAD}=L_T-L_{COG\ CW}-L_{COG\ to\ EDGE},$$

in which $L_{COG\ to\ EDGE}$ is a length from the counterweight center of gravity to the outer edge of the counterweight. This assumes that the counterweights 56*a,b* have the same length $L_{COG\ to\ EDGE}$ from the counterweight center of gravity to the outer edge of the counterweight. If the counterweights 56*a,b* have different lengths $L_{COG\ to\ EDGE}$ from the counterweight center of gravity to the outer edge of the counterweight, the $X_{LAG}$ and $X_{LEAD}$ values may be individually calculated.

If the centers of gravity of the counterweights 56*a,b* are to be located at different positions along the crank arm 40, then suitable adjustments can be made to the equations above. As mentioned above, different positions of the counterweights 56*a,b* along the crank arms 40 may be preferable in situations where the counterweights are already secured to the crank arms, and it is desired to relocate only one of the counterweights on each crank arm.

It may now be fully appreciated that the above disclosure provides significant improvements to the art of configuring surface pumping units for efficient operation. In examples described above, the counterweights 56*a,b* are located at positions that provide for effective counterbalancing of the torque $T_{CBE\ UP}$ at the crankshaft 58 due to the polished rod load PRL at a maximum torque factor angle $\theta_{TF\ MAX\ UP}$ of the crank arm 40. The principles described above can be used to provide for efficient operation of the prime mover 44, and reduce wear and maintenance requirements of the pumping unit 12.

The above disclosure provides to the art a method 70 of balancing a beam pumping unit 12 for use with a subterranean well. In one example, the method 70 can comprise: securing one or more counterweights 56 to one or more crank arms 40 of the beam pumping unit 12, thereby counterbalancing a torque T applied at a crankshaft of the beam pumping unit at a maximum torque factor TF position of the crank arms 40 due to a polished rod load PRL and any structural unbalance B of the beam pumping unit 12.

The maximum torque factor TF position of the crank arms 40 may occur on an upstroke or on a downstroke of the beam pumping unit 12.

The counterbalancing step may include a torque applied at the crankshaft 58 at the maximum torque factor TF position of the crank arms 40 due to weights of the crank arms 40, the counterweights 56 and one or more wrist pins 52 equaling the torque applied at the crankshaft 58 at the maximum torque factor TF position of the crank arms 40 due to the polished rod load PRL and any structural unbalance B of the beam pumping unit 12.

The securing step may include positioning the counterweights 56*a,b* at respective positions $X_{LAG}$, $X_{LEAD}$ along the crank arms 40, so that a torque applied at the crankshaft at the maximum torque factor TF position of the crank arms 40 due to weights of the crank arms $Wt_{CRANK}$, the counterweights $Wt_{CW}$ and one or more wrist pins $Wt_{WRIST}$ equals the torque applied at the crankshaft 58 at the maximum torque factor TF position of the crank arms 40 due to the polished rod load PRL and any structural unbalance B of the beam pumping unit 12.

The method 70 may further comprise: calculating a first torque $T_{CW\ UP}$ at the crankshaft 58 due to the counterweights 56 at a maximum absolute value torque factor position $\theta_{TF\ MAX\ UP}$ of the crank arms 40 on an upstroke of the beam pumping unit 12, calculating a second torque $T_{CW\ DOWN}$ at the crankshaft 58 due to the counterweights 56 at a maximum absolute value torque factor position $\theta_{TF\ MAX\ DOWN}$ of the crank arms 40 on a downstroke of the beam pumping unit 12, calculating an absolute value of a difference between the first and second torques $T_{CW\ UP}-T_{CW\ DOWN}$, and comparing the absolute value of the difference between the first and second torques $T_{CW\ UP}-T_{CW\ DOWN}$ to a balance tolerance.

After the comparing step, and in response to the absolute value of the difference between the first and second torques $T_{CW\ UP}-T_{CW\ DOWN}$ being greater than the balance tolerance, the method 70 may include selecting different counterweights 56 and/or different crank arms 40.

The maximum torque factor TF position of the crank arms 40 is a rotational position at which a torque T applied at the crankshaft 58 due to the polished rod load PRL is at a maximum.

The polished rod load PRL can be an average of a load applied to the beam 34 via the polished rod 24 on an upstroke of the beam pumping unit 12 and a load applied to the beam 34 via the polished rod 24 on a downstroke of the beam pumping unit 12.

Also provided to the art by the above disclosure is a well system 10. In one example, the well system 10 can comprise: a beam pumping unit 12 including a gear reducer 42 having a crankshaft 58, crank arms 40 connected to the crankshaft 58, a beam 34 connected at one end to the crank arms 40 and at an opposite end to a rod string polished rod 24, and counterweights 56*a,b* secured to the crank arms 40. A torque applied at the crankshaft 58 at a maximum torque factor TF position of the crank arms 40 due to weights of the crank arms 40, the counterweights 56*a,b* and one or more wrist pins 52 can equal a torque applied at the crankshaft 58 at the maximum torque factor TF position of the crank arms 40 due to a load applied to the beam 34 via the polished rod 24 and any structural unbalance B of the beam pumping unit 12.

The load applied to the beam 34 via the polished rod 24 may be an average of a load applied to the beam 34 via the polished rod 24 on an upstroke of the beam pumping unit 12 and a load applied to the beam 34 via the polished rod 24 on a downstroke of the beam pumping unit 12.

The maximum torque factor TF position of the crank arms 40 may be a non-horizontal position ($\theta \neq 90°$ or $270°$) of the crank arms 40. The maximum torque factor TF position of the crank arms 40 may be in an upstroke or in a downstroke of the beam pumping unit 12.

Another example of the method 70 of balancing a beam pumping unit 12 for use with a subterranean well can comprise: determining positions $X_{LAG}$, $X_{LEAD}$ of respective counterweights 56*a,b* along crank arms 40 at which a torque applied at a crankshaft 58 at a maximum torque factor TF position of the crank arms 40 due to weights of the crank arms 40, the counterweights 56*a,b* and one or more wrist pins 52 equals a torque applied at the crankshaft 58 at the maximum torque factor TF position of the crank arms 40 due to a polished rod load PRL and any structural unbalance B of the beam pumping unit 12, and counterbalancing the torque applied at the crankshaft 58 at the maximum torque factor TF position of the crank arms 40 due to a polished rod load PRL and any structural unbalance B of the beam pumping unit 12 by securing the counterweights 56*a,b* to the crank arms 40 at the respective positions $X_{LAG}$, $X_{LEAD}$.

The maximum torque factor position $\theta_{TF\ MAX\ UP}$ of the crank arms 40 may occur on an upstroke of the beam pumping unit 12. The maximum torque factor position $\theta_{TF\ MAX\ DOWN}$ of the crank arms 40 may occur on a downstroke of the beam pumping unit 12.

The method 70 may include calculating a first torque $T_{CW\ UP}$ at the crankshaft 58 due to the counterweights 56*a,b* at a maximum absolute value torque factor position $\theta_{TF\ MAX\ UP}$ of the crank arms 40 on an upstroke of the beam pumping unit 12, calculating a second torque $T_{CW\ DOWN}$ at the crankshaft 58 due to the counterweights 56*a,b* at a maximum absolute value torque factor position $\theta_{TF\ MAX\ DOWN}$ of the crank arms 40 on a downstroke of the beam pumping unit 12, calculating an absolute value of a difference between the first and second torques $T_{CW\ UP}-$ $T_{CW\ DOWN}$, and comparing the absolute value of the difference between the first and second torques $T_{CW\ UP}-T_{CW\ DOWN}$ to a balance tolerance.

After the comparing step, and in response to the absolute value of the difference between the first and second torques $T_{CW\ UP}-T_{CW\ DOWN}$ being greater than the balance tolerance, the method 70 may include selecting at least one of different counterweights 56*a,b* and different crank arms 40.

The polished rod load PRL may be an average of a load applied to a beam 34 of the pumping unit 12 via the polished rod 24 on an upstroke of the beam pumping unit 12 and a load applied to the beam 34 via the polished rod 24 on a downstroke of the beam pumping unit 12.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well system, comprising:

a beam pumping unit including a gear reducer having a crankshaft, crank arms connected to the crankshaft, a beam connected at one end to the crank arms and at an opposite end to a rod string polished rod, and counterweights secured to the crank arms, and in which a torque applied at the crankshaft at a maximum torque factor position of the crank arms due to weights of the crank arms, the counterweights and one or more wrist pins counterbalances a torque applied at the crankshaft at the maximum torque factor position of the crank arms due to a load applied to the beam via the polished rod and any structural unbalance of the beam pumping unit.

2. The well system of claim 1, in which the load applied to the beam via the polished rod is an average of a load applied to the beam via the polished rod on an upstroke of the beam pumping unit and a load applied to the beam via the polished rod on a downstroke of the beam pumping unit.

3. The well system of claim 1, in which the maximum torque factor position of the crank arms is a non-horizontal position of the crank arms.

4. The well system of claim 1, in which the maximum torque factor position of the crank arms is in an upstroke of the beam pumping unit.

5. The well system of claim 1, in which the maximum torque factor position of the crank arms is in a downstroke of the beam pumping unit.

* * * * *